United States Patent [19]

Kramer et al.

[11] 4,419,642

[45] Dec. 6, 1983

[54] SOLENOID WITH SATURABLE ELEMENT

[75] Inventors: Kenneth D. Kramer, Waterloo, Iowa; Kenneth J. Stoss, Stillwater, Okla.; Gregory E. Sparks, Waterloo, Iowa

[73] Assignee: Deere & Company, Moline, Ill.

[21] Appl. No.: 343,651

[22] Filed: Jan. 28, 1982

[51] Int. Cl.[3] ..... H01F 7/08

[52] U.S. Cl. ..... 335/227; 335/258

[58] Field of Search ..... 335/227, 251, 255, 257, 335/258, 239, 277, 273, 84, 85

[56] References Cited

U.S. PATENT DOCUMENTS 3,517,360 6/1970 Gray ..... 310/30

3,571,769 3/1971 Pegram ..... 335/227

*Primary Examiner*—Harold Broome

[57] ABSTRACT

A solenoid includes a coil, a pole assembly, an armature movable in the pole assembly and an air gap separating the armature from part of the pole assembly. A single mumetal washer may be fixed to the armature adjacent the air gap or a pair of mumetal washers may be fixed to the armature and to one of the pole parts on opposite sides of the air gap.

10 Claims, 5 Drawing Figures

SOLENOID WITH SATURABLE ELEMENT

BACKGROUND OF THE INVENTION

The present invention relates to the structure of a solenoid.

Most conventional type solenoids have a non-linear, force-current relationship. For example, at low current levels, the force changes caused by small current changes are smaller than the force changes caused by similar current changes at higher current levels. Such a force-current relationship is satisfactory when the solenoid is used as an on-off type actuator. However, where a proportional-type control function is needed, a linear-sloped force-current relationship would be desirable, such as where the force increases linearly as the current increases. In the past, various solenoid modifications have been utilized to provide particular force-displacement characteristics. For example, conical armatures and stops have been used to provide a uniform or constant force over a range of displacements, (see Mark's *Standard Handbook for Mechanical Engineers,* 7th edition, 1967, page 15–106, and U.S. Pat. Nos. 4,091,348 and 4,044,652). A similar uniform force-displacement relationship has been achieved in a solenoid made by Ledex, Inc. with a cylindrical steel shunt with a bevelled end. However, none of these arrangements provide a solenoid with the desired linear sloped force-current characteristic.

SUMMARY OF THE INVENTION

It is an object of the present invention to provide a solenoid which is suitable for proportional control applications.

It is a further object of the present invention to provide a solenoid with a substantially linear force-coil current relationship.

These objects are achieved by placing in the solenoid flux flow path a piece of highly permeable material with an abrupt saturation transition which occurs at flux densities lower than the flux density at which magnetic saturation occurs in the other solenoid components in the flux circuit. In one embodiment, a pair of matching mumetal washers with tapered cross-sectional shapes are fixed to the ends of the armature and one of the pole parts on opposite sides of the air gap. In another embodiment, a single washer with tapered or trapezoidal cross-section is fixed to an end of the armature adjacent the air gap. In a third embodiment, a cylindrical annular washer with annular grooves in its inner and outer peripheral surfaces is fixed to the end of the armature.

DETAILED DESCRIPTION

Figure 1:
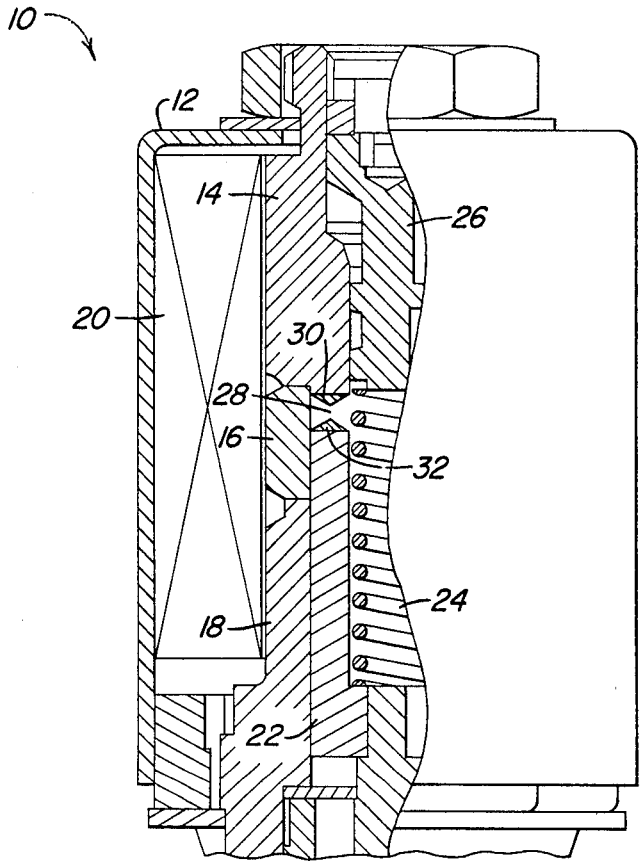
FIG. 1 is a partial sectional view of a solenoid constructed according to the present invention.

A solenoid 10 has a cover 12 which encloses a pole assembly having a soft steel ferromagnetic first part 14, a non-ferromagnetic stainless steel second part 16 and a ferromagnetic soft steel third part 18, and a coil 20. The pole assembly parts are cylindrical and form a chamber which slidably receives a hollow cylindrical armature 22. A spring 24 received by the armature 22 is biased to urge the armature downwards, viewing FIG. 1. A spring tension adjusting member 26 is threadably received by the first pole part 14 and engages one end of the spring 24.

An air gap 28 separates the annular end faces 30 and 32 of the pole part 14 and the armature 22, respectively. As current flows through the coil 20, a magnetic flux is generated which flows through a magnetic circuit made up of the cover 12, the pole parts, 14–18, the air gap 28 and the armature 22. This flux flow creates a force which tends to move the armature 22 upwards, viewing FIG. 1, and against the bias of spring 24.

A saturable element or elements are positioned in the air gap region. Alternative saturable element configurations are shown in the enlarged views of the air gap regions shown in FIGS. 2–4.

Figure 2:
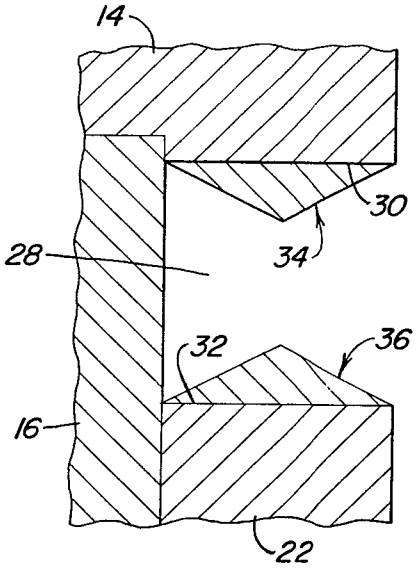

In FIG. 2, the saturable elements are comprised of a pair of identical annular washers 34 and 36, each fixed to a corresponding one of surfaces 30 and 32, respectively. Each washer 34 and 36 has a tapered cross-sectional shape with larger ends fixed to the pole part 14 and the armature 22, respectively, and with smaller ends extending towards each other and into the air gap 28. More particularly, each washer 34 and 36 has a cross-section in the shape of an isosceles triangle with sides which form, for example, a 27 degree angle with its base. The apexes of the washers are oriented toward the center of the air gap 28 and towards each other. The washers are formed of a magnetic material which, at low flux densities, has a higher magnetic permeability than that of steel and which abruptly saturates at flux densities which are lower than the flux density at which saturation occurs in the steel of the armature and pole parts. An example of a suitable washer material is known by the name "Mumetal".

Figure 3:
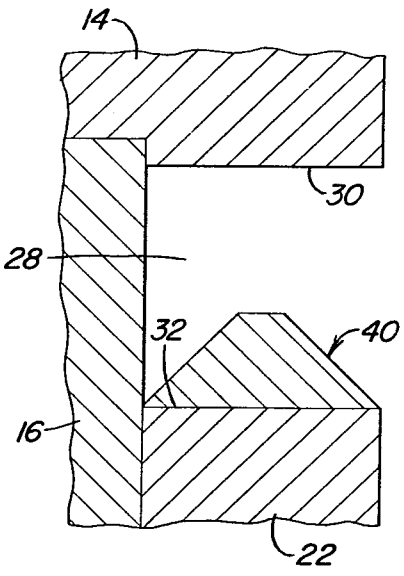

An alternative embodiment of the saturable element is shown in FIG. 3. In this embodiment, the saturable element is a single annular mumetal ring 40 having a trapezoidal cross-sectional shape with its large end fixed to the armature 22, with its small end extending into the air gap 28, and with its sides forming, for example, a 45 degree angle with its base.

Figure 4:
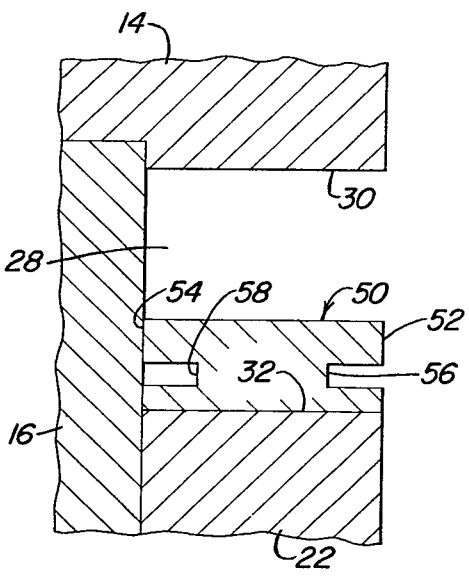
FIGS. 2, 3, and 4 are enlarged views of a portion of FIG. 1 illustrating alternate embodiments of the present invention.

A third saturable element embodiment 50 is seen in FIG. 4 wherein the element 50 is in the form of a flat washer with cylindrical inner and outer peripheral surfaces 52 and 54. Annular grooves 56 and 58 are formed in the surfaces 52 and 54. The area between the grooves 56 and 58 comprises a flux constricting area or region where magnetic saturation occurs.

MODE OF OPERATION

When current is applied to the coil 20 of solenoid 10, magnetic flux flows through the cover 12, the pole part 14, the air gap 28, the saturable element in the air gap, the armature 22 and the pole part 18, thus creating a force which tends to move the armature 22 upwards, viewing FIG. 1, to decrease the axial length of the air gap 28. The non-magnetic nature of the stainless steel part 16 forces the flux to flow through the air gap. For relatively small air gap lengths, the force F may be approximately described by the equation:

$$F = A(In \div LC)^2$$

Where A is the area of the core, n is the number of turns in the coil, L is the length of the gap and C is a constant.

Thus, it can be seen that a conventional non-linear force-current relationship derives from its dependence upon the square of the current, I.

This conventional force-current relationship also derives from the fact that most conventional solenoids operate at flux levels wherein the magnetic permeability of the materials in the flux flow path increase with increasing flux density and thus, with increasing current. Thus, the fact that the overall reluctance (or resistance to magnetic flux flow) in the components of the conventional solenoid decreases in response to increasing flux densities and coil current also contributes to the non-linear nature of force-current relationship.

The operation of the embodiment of FIGS. 1 and 2 will now be described with the assumption that the length of the air gap between surfaces 30 and 32 of the pole part 14 and the armature 22 is held constant while the current in coil 20 is varied. It is believed that due to the tapered nature of washers 34 and 36, the magnetic flux which flows from one washer to the other and across the air gap 28 tends to be constricted or concentrated towards a center line (in reality, a cylindrical-shaped surface) which interconnects the apexes of the two washers. This is because the flux tends to flow along the path of least reluctance which, in this case, is in the region of the shortest distance or air gap length between washers 34 and 36. As the coil current and the magnetic flux increase in magnitude, it is believed that a small region around the apex of each washer becomes saturated with magnetic flux. Since the washers are mumetal, this saturation occurs at a flux density and current level which is lower than the flux densities and current levels at which saturation would occur in the other components of the solenoid 10, such as the cover 12, pole parts 14 and 18, and the armature 22. Now, once a region of the washers becomes flux saturated, its reluctance to flux flow will increase if the current and flux is further increased. This reluctance increase counteracts the reluctance decrease of the other parts of the solenoid and reduces the current-squared dependence of the force-current relationship and thus, tends to linearize the otherwise quadratic nature of the force-current relationship.

It is also believed that as the current and flux are increased, the size of the saturated regions near the apexes of the washers 34 and 36 will also increase. Thus, the borders of the unsaturated regions of the washers 34 and 36 move farther apart with increasing coil current. This increased distance between the unsaturated regions has an effect which is analogous to increasing the length of the air gap which also tends to increase the overall reluctance of the flux flow path and thus, further aids in linearizing the force-current relationship.

The above operational description also relates to the embodiment of FIG. 3, except, of course, the variable saturable region is limited to only the single washer 40.

Turning now to the embodiment of FIG. 4, increases in coil current and flux tends to saturate the region of washer 50 between the grooves 56 and 58. As saturation occurs, the reluctance of the washer 50 increases in response to further increases in current and flux. Also, as the region of washer 50 saturates, more flux tends to flow directly across the air gaps defined by the two grooves 56 and 58, these groove air gaps being relatively small in length when compared to the length of the air gap 28. Both of these effects tend to increase the reluctance of the washer 50 in response to further increases in current and flux, thus tending to linearize the force-current relationship of the solenoid.

Figure 5:
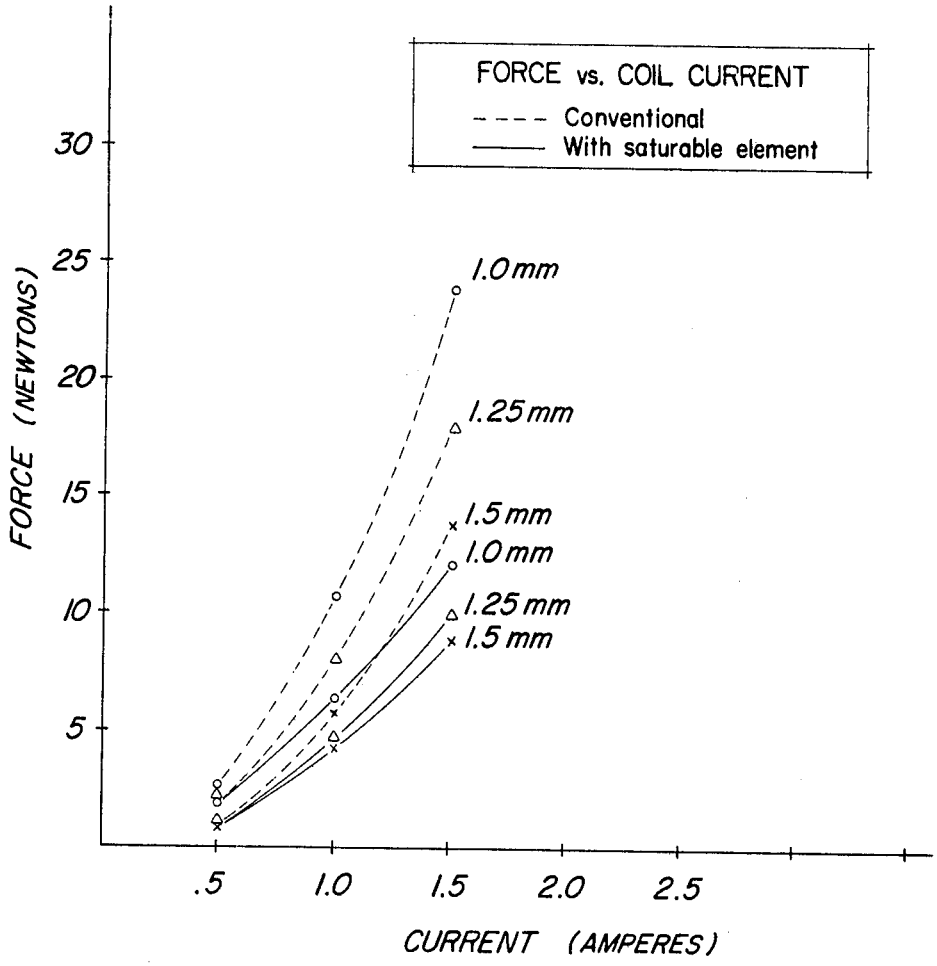
FIG. 5 is a graph of experimental results from tests performed on a conventional solenoid and a similar solenoid modified, as shown in FIGS. 1 and 2.

FIG. 5 illustrates some experimental results performed on a conventional solenoid with a steel armature with flat ends at the border of the air gap and on a similar solenoid, but modified with mumetal washers, as shown in FIG. 2 on both the armature 22 and the pole part 14. For both the conventional and modified solenoids, the force on the armature was measured at fixed air gap lengths of 1.0, 1.25 and 1.5 millimeters as the coil current was varied. The results for the modified solenoid (shown in solid lines) show a substantially more linear force-current relationship than do the results for the conventional solenoid (shown in dashed lines), over a useful range of coil currents and air gaps.

We claim:

1. A solenoid comprising:

a cylindrical pole element;

a hollow cylindrical armature element axially movable with respect to the pole element;

an air gap interposed between the armature and pole elements, the gap, armature element and pole element comprising at least a portion of a magnetic flux circuit;

an annular magnetically permeable and saturable member located in the air gap, the saturable member being formed of material other than that of the armature element and pole element and having an abrupt magnetic saturation point at a flux density lower than the flux density at which magnetic saturation occurs in the armature element and the pole element; and coil means surrounding the elements for creating a flow of magnetic flux through the flux circuit to generate a force which acts axially upon the armature element.

2. The solenoid of claim 1, wherein:

the saturable member is located in the air gap between the armature and pole elements, the saturable member being fixed to an end surface of at least one of the armature and pole elements.

3. The solenoid of claim 2, wherein:

the saturable member has a tapered cross-sectional shape extending from a larger end fixed to the one of the armature and pole elements to a smaller end extending towards the other of the armature and pole elements.

4. The solenoid of claim 1, wherein:

the saturable member has a tapered cross-sectional shape having a larger end fixed to the armature and a smaller end projecting towards the pole element and into the air gap.

5. The solenoid of claim 1, wherein:

the saturable member comprises an annular ring mounted on the armature and having a trapezoidal-shaped cross-section.

6. The solenoid of claim 1, wherein:

the saturable member comprises an annular ring mounted on the armature and having inner and outer peripheral surfaces, both peripheral surfaces having annular grooves therein defining therebetween a flux-constricting portion of the saturable member.

7. The solenoid of claim 1, wherein:

the saturable member consists of mumetal.

8. The solenoid of claim 1, wherein the annular saturable member has a triangular cross-sectional shape having an apex extending into the gap.

9. The solenoid of claim 1, further comprising:

a further annular permeable and saturable member located in the air gap, each saturable member being fixed to a corresponding one of the pole element and armature element.

10. The solenoid of claim 9, wherein:

both saturable members have triangular cross-sections with apexes oriented towards each other.

* * * * *